US006342867B1

(12) United States Patent
Bell

(10) Patent No.: US 6,342,867 B1
(45) Date of Patent: Jan. 29, 2002

(54) NESTED TURNSTILE ANTENNA

(75) Inventor: H. Clark Bell, Chatsworth, CA (US)

(73) Assignee: Navcom Technology, Inc., Redondo Beach, CA (US)

( * ) Notice: Subject to any disclaimer, the term of this patent is extended or adjusted under 35 U.S.C. 154(b) by 0 days.

(21) Appl. No.: 09/540,747

(22) Filed: Mar. 31, 2000

(51) Int. Cl.[7] ..... H01Q 21/26
(52) U.S. Cl. ..... 343/795; 343/797
(58) Field of Search ..... 343/797, 795; H01Q 21/26

(56) References Cited

U.S. PATENT DOCUMENTS 4,686,536 A * 8/1987 Allcock ..... 343/797
5,418,544 A * 5/1995 Elliot ..... 343/797
5,933,788 A * 8/1999 Faerber et al. ..... 343/797

* cited by examiner

*Primary Examiner*—Michael C. Wimer
(74) *Attorney, Agent, or Firm*—Pennie & Edmonds LLP

(57) ABSTRACT

A circularly polarized multifrequency antenna is described. The antenna includes a reflector having a first side and a second side, a first crossed dipole pair having a first resonant frequency and a second crossed dipole pair having a second resonant frequency. The first and second dipole pair are symmetrically disposed on the first side of the reflector and configured to be fed with equal power in a relative phase rotation of 0°, 90°, 180° and 270°.

22 Claims, 4 Drawing Sheets

NESTED TURNSTILE ANTENNA

FIELD OF THE INVENTION

The present invention generally relates to circularly polarized (CP) radio antennas and, more particularly, to an antenna comprising at least two pairs of crossed dipole antennas.

BACKGROUND OF THE INVENTION

Conventional CP radio antennas in a crossed-dipole or "turnstile" configuration are well known in the art. An exemplary conventional CP radio antenna includes crossed dipole antennas fed by a balanced four-phase transmission line and located above a reflecting screen. Its dipole legs of the crossed dipole antennas incline downward toward the screen in order to increase the CP radiation at lower elevation angles relative to the plane of the screen. Antennas of this type can be constructed using simple wires, rods, or printed conductors for the dipole legs. A CP radio antenna having the above discussed features is depicted in FIG. 28-7 of the 3rd edition of the *Antenna Engineering Handbook*, published by McGraw-Hill, relevant portions of which are incorporated herein by reference.

In U.S. Pat. No. 5,519,407, a CP dual frequency antenna is described. This CP antenna includes four identical antenna elements each of which includes an inductor-capacitor trap positioned along the length of each antenna element. This configuration permits the disclosed CP antenna to operate at two different frequency bands.

Furthermore, in U.S. Pat. No. 5,526,009, a linearly polarized (LP) dual frequency antenna is described. This LP antenna includes an antenna assembly that comprises four antenna elements. Each antenna element includes a coil and an elongated arm. Pairs of the elongate arms form dipoles which are of differing lengths so that each pair of antenna elements resonates at a different frequency.

SUMMARY OF THE INVENTION

The present invention provides a nested turnstile antenna structure capable of transmitting and/or receiving CP electromagnetic waves in more than one frequency band. The antenna of the present invention also has a capability to achieve desired elevation radiation patterns within each frequency band.

The present invention is preferably used in reception of CP signals from Global Positioning System (GPS) satellites, and for transmission and reception of L-band communications satellite CP signals (e.g., signals used in the International Maritime Satellite System (INMARSAT) service), but it is not limited to use with above-discussed systems. For instance, the present invention may also be used for multifrequency communications using CP signals, for which omnidirectional, elevation-tailored radiation patterns are required.

In the present invention two or more turnstile antenna structures share a common symmetry axis and common reflector. Various design characteristics (e.g., lengths, positions along its symmetry axis, inclinations to a reflector and like) of radiating elements of crossed dipole pairs are preferably selected to achieve the aforementioned radiation characteristics.

In particular the present invention provides a circularly polarized multifrequency antenna. The antenna includes a reflector having a first side and a second side, a first crossed dipole pair having a first resonant frequency and a second crossed dipole pair having a second resonant frequency. The first and second dipole pair are symmetrically disposed on the first side of the reflector.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE INVENTION

Figure 1:
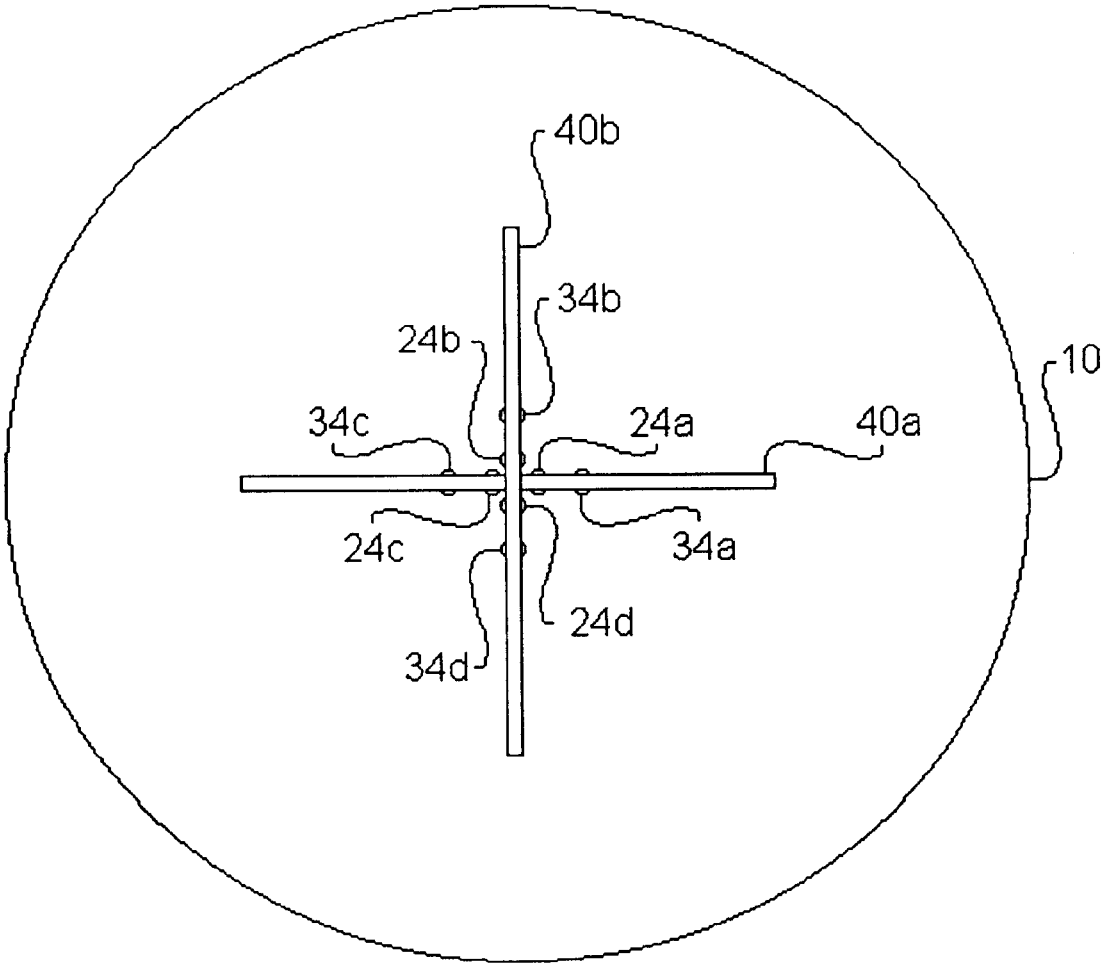
FIG. 1 is a top view of an antenna according to one embodiment of the present invention.
Figure 2:
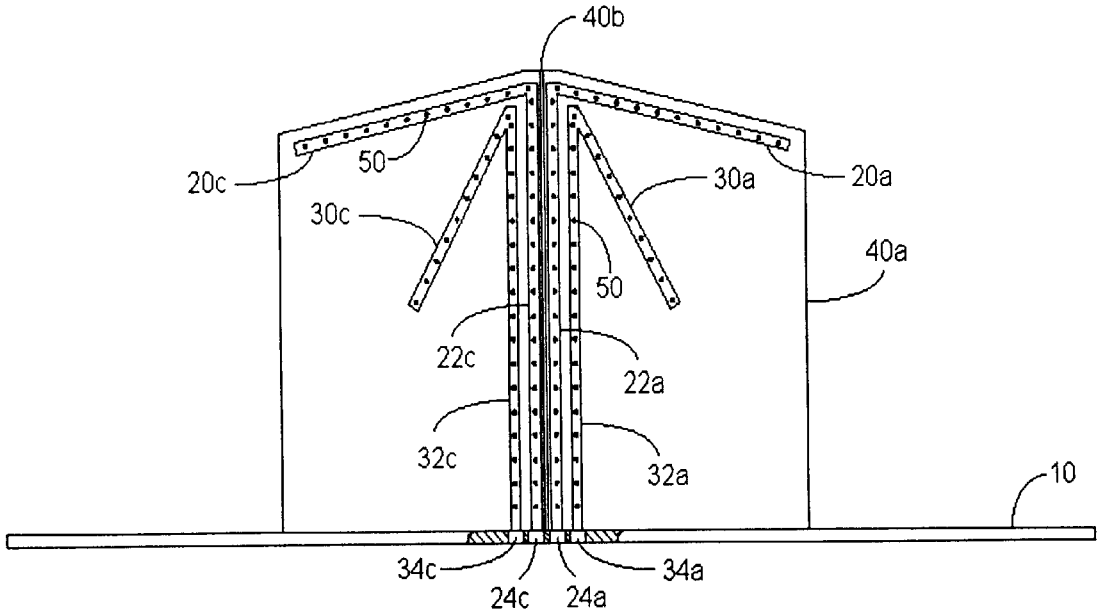
FIG. 2 is an elevation view of the antenna of FIG. 1 illustrating one of the two sets of crossed dipoles.
Figure 3:
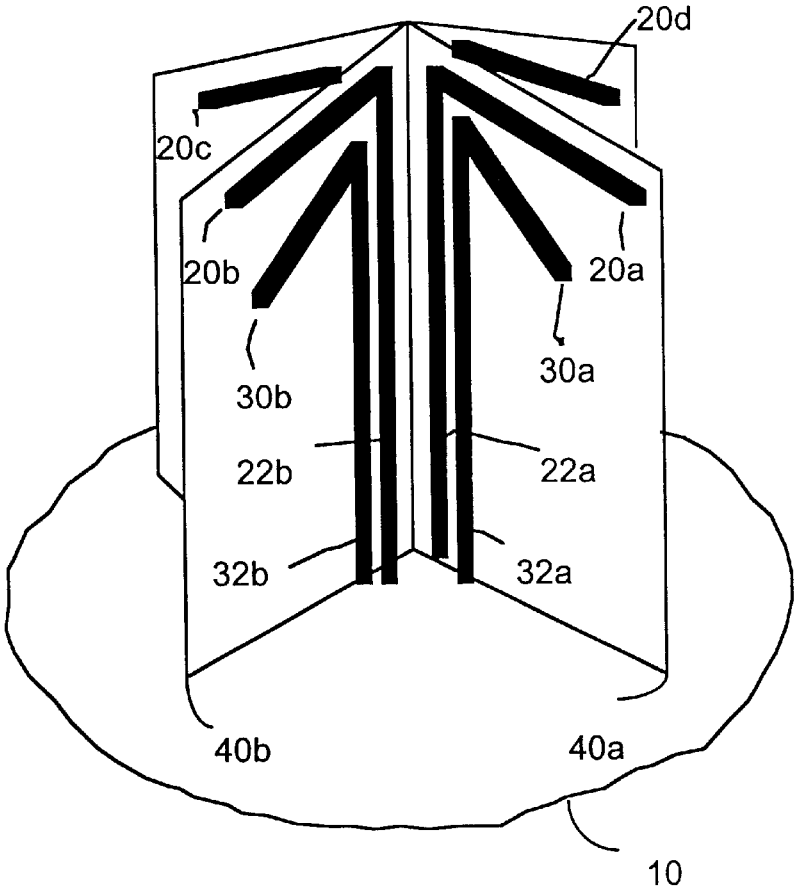
FIG. 3 is a schematic diagram illustrating the relative phase between the dipole elements in the arrangement of FIG. 1.

Referring to FIGS. 1–3, an antenna of the present invention preferably includes a reflector 10 supporting a pair of circuit boards 40*a* and 40*b*. Reflector 10 is preferably planar. It should be noted that reflector 10 is not required to be planar. Therefore, in alternative embodiments, reflector 10 may have curved or cavity surfaces or other shaped surfaces as known in the art. The antenna is enclosed in a radome (not shown) for weather protection.

Reflector 10 preferably is in the shape of a circle as illustrated in FIG. 1. The diameter of the circular shaped reflector is approximately 8 inches. Alternatively, reflector 10 may have any quadranal symmetrical shape such as a square or an octagon. A vertical axis perpendicular to reflector 10 passes through the center thereof. The vertical axis is also the symmetry axis of the antenna. The transmission and reception characteristics of the antenna are of concern primarily in the "half-space" above a plane containing reflector 10. Reflector 10 also establishes a ground plane below the antenna for electromagnetically isolating circuits and other structures underneath reflector 10 from the antenna.

Circuit boards 40*a* and 40*b* include a pair of opposing slots (not shown), cut at least halfway across the center of the two circuit boards, allowing the two boards to be slipped together, resulting in an interlocking structure. Each circuit board is preferably fabricated from high frequency circuit material, 0.031 inch thick, with electro-deposited copper on both sides (e.g., type RO4003 from Rogers Corporation, Chandler, Ariz.). Other circuit board material may be used depending on the electrical characteristics of the material at the desired operating frequencies. Using standard printed circuit technology, circuit boards 40*a* and 40*b* are etched to remove the electro-deposited copper. This leaves copper lines on opposite sides of circuit boards 40*a* and 40*b* which form the radiating elements 20*a–d*, 30*a–d* and feed lines 22*a–d*, 32*a–d*. The widths of the copper lines are substantially equal to 0.1 inch. To maintain equal electric field potential between the conductors on opposite sides of the boards, plated through holes 50 are preferably placed every 0.2 inch along the center of the copper lines as shown in FIG. 2 with black dots. Subsequently, the copper lines on circuit boards 40*a* and 40*b* are tin-lead plated for corrosion prevention. The above-mentioned values given for the circuit board thickness, conductor line width, and spacing of the plated through holes may be chosen as a matter of convenience, although they preferably should be no more than 5% of the wavelength at the highest operating frequency of the antenna.

The copper lines (i.e., conductors) on circuit boards 40*a* and 40*b* form a first turnstile antenna (i.e., a first pair of crossed dipole antennas) operating within a first frequency band and a second turnstile antenna (i.e., a second pair of crossed dipole antennas) operating within a second frequency band. The first antenna comprises radiating elements 20*a–d*, that are connected to feed lines 22*a–d*. The second turnstile antenna comprises radiating elements 30*a–d*, that are connected to feed lines 32*a–d*. In reflector 10, holes 24*a–d*, for the first turnstile antenna, and holes 34*a–d*, for the second turnstile antenna, allow connection of the corresponding feed lines to circuits (not shown) located beneath reflector 10.

Figure 4:
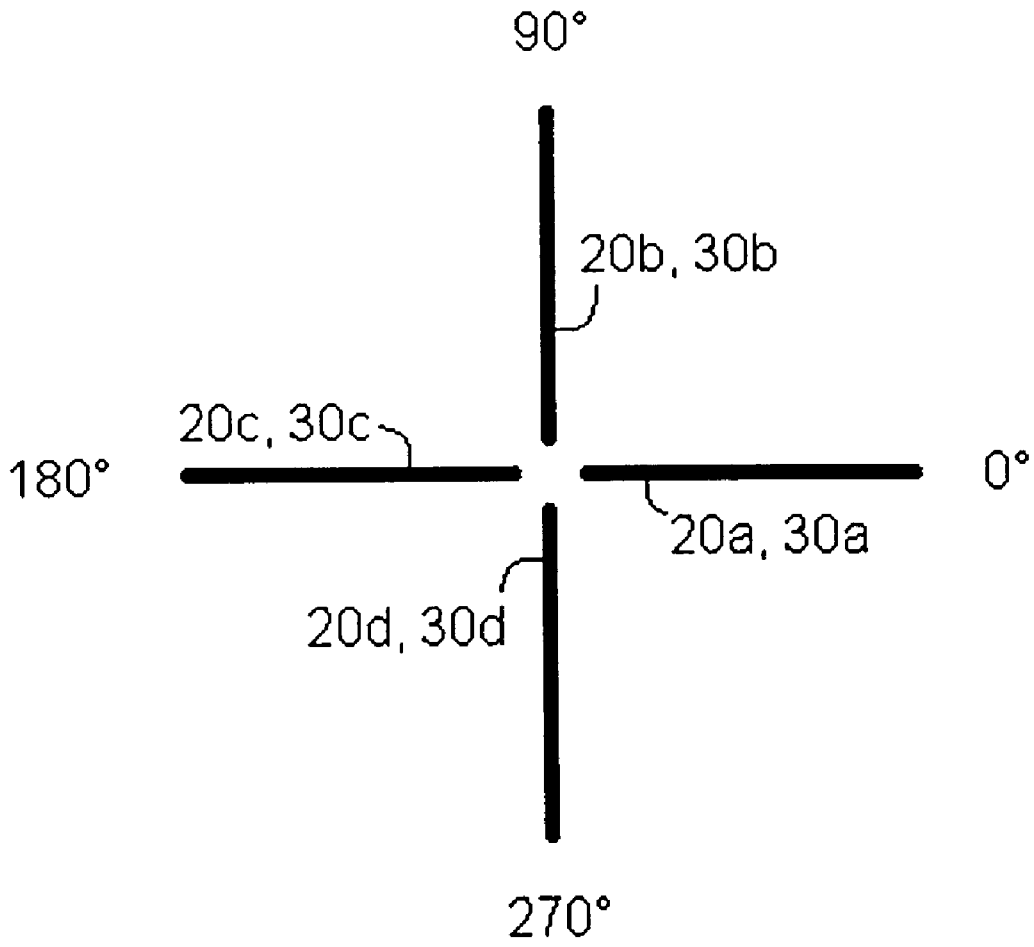
FIG. 4 is a perspective view of the antenna of FIG. 1.

Radiating elements 20*a–d* of the first turnstile antenna, and corresponding feed lines 22*a–d*, and radiating elements 30*a–d* of the second turnstile antenna, and corresponding feed lines 32*a–d*, are spaced at 90° intervals about the vertical axis of reflector 10. This allows each of the first and second turnstile antennas, in combination with the reflector, to exhibit quadranal symmetry about the vertical axis. As a result, when signals of equal magnitude, in the relative phase rotation of 0°, 90°, 180° and 270° as illustrated in FIG. 4, propagate either on feed lines 22*a–d* in combination, or on feed lines 32*a–d* in combination, the corresponding first or second turnstile antenna transmits or receives a CP electromagnetic wave along the vertical axis.

There are many well known dividing/phasing circuits which can divide a signal into four equal amplitude signals having relative phase of 0°, 90°, 180° and 270°. Examples of suitable dividing/phasing circuits include, but are not limited to, an 180° hybrid coupler which feeds into two 90° hybrid couplers or a 90° hybrid coupler which feeds into two 180° hybrid couplers; and a four-way in-phase divider which feeds four transmission lines each progressively increasing in length by 90°.

Returning back to the discussion of the circuit boards 40*a* and 40*b*, the spacings of the centers of the first antenna feed lines 22*a–d* and the second antenna feed lines 32*a–d* from the vertical axis discussed above in connection with reflector 10 are substantially equal to 0.1 inch and 0.3 inch. The lengths of the first and second antenna feed lines 22*a–d*, 32*a–d* are substantially equal to 3.762 and 3.562 inches, and the lengths of the first and second antenna radiating elements 20*a–d*, 30*a–d* are substantially equal to 2.593 and 2.360 inches. Radiating elements 20*a–d* of the first (low band) turnstile antenna are preferably inclined at an angle substantially equal to 12.5° below the horizontal, and radiating elements 30*a–d* of the second (high band) turnstile antenna are preferably inclined at an angle substantially equal to 60° below the horizontal.

It should be noted that one skilled in the art will recognize that there is a wide variation of possible dimensions, depending on the operating frequencies and desired performance, which will provide a useful multifrequency CP antenna. The resulting antenna impedances may require additional impedance matching structures. The lengths of the radiating elements will nominally be 0.25λ at the corresponding operating frequencies but may be longer or shorter by substantial amounts depending on the other dimensions and whether or not impedance matching circuits are included. For instance, it can be in the range of 0.20λ–0.35λ. Similarly, the lengths of the feed lines will nominally be 0.5λ but may also vary substantially. For instance, it can be in the range of 0.35λ–0.55λ. The inclination angles of the radiating elements and the spacings of the feed lines from the vertical axis will also influence the performance and be subject to a substantial range of dimensions.

Even though the above discussed crossed dipole pairs of the present invention use linear dipole elements, other types of elements in various combinations may also be used such as, but not limited to, segmented linear, arcuate, folded dipole elements, as well as elements with more general two-dimensional shapes. In addition, the invention is not limited to the geometry of the preferred embodiment in which the crossed dipole antennas are rotationally aligned. For example, the crossed dipole antennas may be disposed, relative to each other, at an angle of rotation of 45° about the common symmetry axis (i.e., the vertical axis discussed above in connection with reflector 10). Furthermore, a transmission line feed as described herein with quadranal symmetry and comprising four conductors may additionally include, for example, a single shield, grounded to the reflector, which surrounds all feed line conductors, or grounded shields each surrounding a feed line conductor so that each conductor-shield pair constitutes a coaxial transmission line.

It should be noted that additional turnstile antennas may be included in embodiments of the present invention, thus providing operational capability at corresponding additional frequencies. Moreover, the crossed dipole pairs and the transmission line feeds may be connected in various combinations which may seem more advantageous when used in combination with particular system components including transmitters, receivers, multiplexers and phasing networks. For example, one set of feed lines may be connected to two sets of radiating elements.

The antenna of the present invention is preferably utilized in a system which operates from a terrestrial vehicle, with the antenna mounted atop the vehicle such that the reflector 10 is parallel to the ground when the vehicle is level. Because the vehicle may be oriented in an arbitrary direction, it is desirable that the antenna radiation pattern be substantially omnidirectional (i.e., having little variation in azimuth) and further that there be reasonable pattern coverage from zenith down to low elevation angles for operation from the equator to higher latitudes.

The preferred operating frequencies of the antenna of the present invention are:

| Signal | Frequency |
|---|---|
| GPS L2 | 1227.6 MHz |
| L-band Receive | 1520–1560 MHz |
| GPS L1 | 1575.42 MHz |
| L-band Transmit | 1620–1660 MHz |

It should be noted that satisfactory performance can be obtained by operating the antenna in two frequency bands, a low band for the GPS L2 signal and a high band encompassing the L-band Receive, GPS L1 and L-band Transmit signals. The first turnstile antenna, comprising radiating elements 20*a–d* preferably operates in the low band, and the second turnstile antenna, comprising radiating elements 30*a–d* preferably operates in the high band.

Operation in the high band results in strong signal coupling from the second turnstile antenna to the first turnstile antenna, which may cause severe detuning or loss of signal strength caused by coupling of high band signals to the low band circuits located beneath reflector 10. These effects are mitigated by using a set of open-circuited transmission-line stubs. Each stub is approximately a quarter wavelength long in the high high band. One stub is connected in shunt to each of the low band circuits beneath reflector 10, close to each of holes 24*a–d* through which the corresponding low band feed lines 22*a–d* are connected. Each stub presents a very low shunt impedance in the high band, thus decoupling the corresponding low band circuit. Operation in the low band results in negligible signal coupling from the first turnstile antenna to the second turnstile antenna, and therefore corresponding low band decoupling stubs are not required.

Although the invention has been described with respect to a preferred embodiment which comprises the best mode contemplated within the present invention, it will be obvious to those skilled in the art that many changes could be made and many apparently different embodiments thus derived without departing from the spirit and scope of the invention. Consequently, it will be appreciated by those skilled in the art that the scope of the invention should not be limited by any of the aforementioned embodiments, but rather that it be interpreted only from the following claims.

What is claimed is:

1. A circularly polarized multifrequency antenna comprising:

a first circuit board having a first surface and a second surface, the first circuit board having conductive lines formed on the first surface and the second surface;

a second circuit board having a third surface and a fourth surface, the second circuit board having conductive lines formed on the third surface and the fourth surface, the circuit boards being assembled to intersect each other at a predetermined angle to each other;

a first crossed dipole pair having a first resonant frequency, the first crossed dipole pair comprising a first set of the conductive lines disposed on the first surface, the second surface, the third surface and the fourth surface; and a second crossed dipole pair having a second resonant frequency and being disposed symmetrically with the first dipole pair, the second crossed dipole pair comprising a second set of the conductive lines disposed on the first surface, the second surface, the third surface and the fourth surface, wherein the first and second dipole pairs are configured to be fed with equal power in a relative phase rotation of 0°, 90°, 180° and 360°.

2. The antenna of claim 1 further comprising:

a reflector, wherein the first and second dipole pairs are disposed on one side of the reflector.

3. The antenna of claim 2 wherein the reflector has a planar circular shape and a diameter of the planar circular reflector is substantially equal to an average wavelength between the first and second resonant frequencies.

4. The antenna of claim 1 wherein the first resonant frequency is substantially equal to 1227.6 MHz and the second resonant frequency is substantially equal to 1575.42 MHz.

5. The antenna of claim 1 wherein the second crossed dipole pair is further configured to receive a signal having a frequency range of 1520–1560 MHz and transmit a signal having a frequency range of 1620–1660 MHz.

6. The antenna of claim 1 wherein the conductive lines are etched from electro-deposited copper.

7. The antenna of claim 1 wherein the conductive lines include a plurality of feed lines and a plurality of radiating lines each of which is coupled to one of the plurality of feed lines.

8. The antenna of claim 7 wherein each feed line of the first crossed dipole antenna has a length substantially equal to 0.46 times an average wavelength for an operating frequency range of the first and second crossed dipole antennas.

9. The antenna of claim 8 wherein the operating frequency range of the first and second crossed dipole antennas is between 1227.6 MHz and 1660 MHz.

10. The antenna of claim 7 wherein each radiating line of the first crossed dipole antenna is inclined approximately at 12.5° compared with a planar surface of the planar reflector.

11. The antenna of claim 7 wherein each radiating line of the second crossed dipole antenna is inclined approximately at 60° compared with a planar surface of the planar reflector.

12. A circularly polarized multifrequency antenna comprising:

a first circuit board having a first surface and a second surface, the first circuit board having conductive lines formed on the first surface and the second surface;

a second circuit board having a third surface and a fourth surface, the second circuit board having conductive lines formed on the third surface and the fourth surface, the circuit boards being assembled to intersect each other at a predetermined angle to each other;

a first crossed dipole pair having a first resonant freequency, the first crossed dipole pair comprising a first set of the conductive lines disposed on the first surface, the second surface, the third surface and the fourth surface; and a second crossed dipole pair having a second resonant frequency and sharing a symmetry axis with the first dipole pair, the second crossed dipole pair comprising a second set of the conductive lines formed on the first surface, the second surface, the third surface and the fourth surface.

13. The antenna of claim 12 further comprising;

a reflector, wherein the first and second crossed dipole pairs are disposed on one side of the reflector.

14. The antenna of claim 13 wherein the reflector has a planar circular shape and a diameter of the planar circular reflector is substantially equal to an average wavelength between the first and second resonant frequencies.

15. The antenna of claim 12 wherein the first resonant frequency is substantially equal to 1227.6 MHz and the second resonant frequency is substantially equal to 1575.42 MHz.

16. The antenna of claim 12 wherein the second crossed dipole pair is further configured to receive a signal having a frequency range that includes 1520 to 1560 MHz and transmit a signal having a frequency range that includes 1620 to 1660 MHz.

17. The antenna of claim 12 wherein the second crossed dipole antenna has an operating frequency range that includes 1520 to 1560 MHz.

18. The antenna of claim 12 wherein the conductive lines are etched from electro-deposited copper.

19. The antenna of claim 12 wherein the conductive lines include a plurality of feed lines and a plurality of radiating lines each of which is coupled to one of the plurality of feed lines.

20. The antenna of claim 19 wherein each feed line of the first crossed dipole antenna has a length in a range of 0.35 to 0.55 times a wavelength corresponding to an operating frequency of the first crossed dipole antenna.

21. The antenna of claim 19 wherein the plurality of radiating lines includes radiating lines of the first crossed dipole antenna that are inclined approximately 12.5 compared with a planar surface of the planar reflector.

22. The antenna of claim 19 wherein the plurality of radiating lines includes radiating lines of the second crossed dipole antenna that are inclined approximately 60°compared with a planar surface of the planar reflector.

* * * * *

UNITED STATES PATENT AND TRADEMARK OFFICE

CERTIFICATE OF CORRECTION

PATENT NO. : 6,342,867 B1
APPLICATION NO. : 09/540747
DATED : January 29, 2002
INVENTOR(S) : H. Clark Bell It is certified that error appears in the above-identified patent and that said Letters Patent is hereby corrected as shown below:

In the Claims:

Column 5, line 39, please delete "360°" and insert -- 270° --.

Signed and Sealed this

Twenty-eighth Day of October, 2008

JON W. DUDAS
*Director of the United States Patent and Trademark Office*